US007246729B2

(12) United States Patent
Harvey et al.

(10) Patent No.: US 7,246,729 B2
(45) Date of Patent: Jul. 24, 2007

(54) GRAVITY ACTUATED COLLAPSIBLE GARMENT HANGER

(76) Inventors: Kevin A. Harvey, 272 Grandview Cir., Camarillo, CA (US) 93010; Robin J. Harvey, 809 La Grange Ave., Newbury Park, CA (US) 91320

( * ) Notice: Subject to any disclaimer, the term of this patent is extended or adjusted under 35 U.S.C. 154(b) by 395 days.

(21) Appl. No.: 10/800,462

(22) Filed: Mar. 15, 2004

(65) Prior Publication Data

US 2005/0199656 A1 Sep. 15, 2005

(51) Int. Cl.
*A41D 27/22* (2006.01)

(52) U.S. Cl. ..... 223/85; 223/89

(58) Field of Classification Search ..... 223/85–98; D6/315

See application file for complete search history.

(56) References Cited

U.S. PATENT DOCUMENTS

| | | | |
|---|---|---|---|
| 478,062 | A | 6/1892 | Laubin |
| 665,314 | A | 1/1901 | Davis |
| 668,673 | A | 2/1901 | Brooks |
| 2,488,219 | A | 11/1949 | Miller |
| 2,494,711 | A | 1/1950 | Kusher |
| 2,496,561 | A | 2/1950 | Saunders |
| 2,576,089 | A | 11/1951 | Ehmke |
| 2,652,958 | A | 9/1953 | Alvord |
| 2,666,561 | A | 1/1954 | Welker |
| 2,679,958 | A | 6/1954 | Massa |
| 2,701,083 | A | 2/1955 | Welker |
| 2,754,039 | A | 7/1956 | Pierce |
| 2,781,157 | A | 2/1957 | Schoch |
| 2,814,426 | A | 11/1957 | Miller |
| 2,819,828 | A | 1/1958 | Thurber |
| 2,827,211 | A | 3/1958 | Bradley |
| 2,884,171 | A | 4/1959 | Knuth |
| 3,254,814 | A | 6/1966 | Weir |
| 3,443,729 | A | 5/1969 | Hannum |
| 3,874,572 | A | 4/1975 | McClenning |
| 4,004,721 | A | 1/1977 | Ross |
| 4,673,115 | A | 6/1987 | LaMont |
| 4,717,053 | A | 1/1988 | Wang |
| 4,813,581 | A | 3/1989 | LaMont |
| 4,905,877 | A | 3/1990 | Gatling |
| 4,948,019 | A | 8/1990 | Rodum |
| 5,007,562 | A | 4/1991 | Brink et al. |

(Continued)

FOREIGN PATENT DOCUMENTS

| | | |
|---|---|---|
| DE | 437663 | 11/1926 |

(Continued)

*Primary Examiner*—Shaun R. Hurley

(57) ABSTRACT

A collapsible garment hanger including a hook element attached to a fixed arm, a sliding arm with a longitudinally oriented slot, a crosspiece extending through the slot, attaching the sliding arm slidably to the fixed arm. When the distal end of the fixed arm tilts upward, gravity will cause the sliding arm to slide away from the distal end of the fixed arm. Whenever the distal end of the fixed arm tilts downward, gravity will cause the sliding arm to slide towards the distal end of the fixed arm. The collapsible garment hanger can also manually slide away from or towards the distal end of the fixed arm. An offset spacing between the outer tip of the sliding arm when it is in the collapsed position and the opposing offset portion of the hanger determines the size of neck of garment through which the hanger will fit.

42 Claims, 12 Drawing Sheets

U.S. PATENT DOCUMENTS

| | | | | | |
|---|---|---|---|---|---|
| 5,022,571 | A | * | 6/1991 | Blanchard | 223/95 |
| D320,313 | S | * | 10/1991 | Gatling | D6/315 |
| 5,383,584 | A | | 1/1995 | Adams | |
| 5,476,199 | A | | 12/1995 | Halverson et al. | |
| 5,480,076 | A | | 1/1996 | Siegel et al. | |
| 5,590,823 | A | | 1/1997 | Lunde | |
| 5,598,957 | A | | 2/1997 | Bell | |
| 5,601,219 | A | * | 2/1997 | Chen | 223/85 |
| 5,718,362 | A | | 2/1998 | Silverman | |
| 5,893,493 | A | | 4/1999 | Noiray | |
| 5,941,429 | A | | 8/1999 | Koons | |
| 6,068,166 | A | | 5/2000 | Kilian | |
| 6,427,882 | B1 | | 8/2002 | Harvey | |
| 6,540,121 | B1 | | 4/2003 | Harvey | |
| 2005/0092787 | A1 | * | 5/2005 | Stokes | 223/94 |

FOREIGN PATENT DOCUMENTS

| | | | |
|---|---|---|---|
| DE | 40488 | | 7/1929 |
| EP | 482509 | A1 * | 4/1992 |
| GB | 2274980 | | 8/1994 |

* cited by examiner

GRAVITY ACTUATED COLLAPSIBLE GARMENT HANGER

BACKGROUND

1. Technical Field

The present invention is generally related to the field of garment hangers, and specifically to a two-piece slidably collapsible garment hanger.

2. Background Art

Garments are sometimes overly stretched and/or damaged when being removed from or placed on rigid hangers in the conventional manner. In addition, the convenience of removing the hanger is impeded by its rigidity.

The stretching of a garment usually occurs because the distance between the hanger arms is greater than the opening of the neck of the garment. To prevent damage to some types of clothing, hangers have to be removed from the garment by manipulating the hanger down through the bottom of the garment. This is not only a cumbersome operation that must be done more by feel than sight, but the hook element may damage the garment during this process. Furthermore, if the garment is a button type, the necessary number of buttons must be undone before removal.

Because of the small necks of some garments, garment hanger manufacturers have attempted to compensate for this problem by making collapsible garment hangers that remedy some of the deficiencies of rigid hangers. In one such class of devices, a central hook element attaches to two sliding arms. These designs allows the two arms to collapse toward the hook element for easier insertion into the neck of a hanger, and, once inserted, the arms slide out to their fully extensible position to hold the garment in place. However, these types of designs do not address adequately the main problem they seek to resolve, as they are often still to large to fit directly into small-necked garments even in their collapsed position. This problem is a function of the need for a sizable central element that is capable of holding both of the sliding arms in place while extended.

In another class of collapsible garment hanger devices, the hangers have two arms that fold downward after releasing a locking member. However, these variants often have manually activated locking devices that require a second hand to release. These designs also often use spring-loaded locking mechanisms and as such suffer from the difficulty of matching the proper spring force to variable garment weights in order to maintain a proper hanging or shoulder angle. Much like the previously described hanger class, these designs also often fail to collapse enough to fit in small-necked garments. This is the result of the fact that in their collapsed position their minimum width is a function of not only the horizontal width of the central element but the width of the folded hanger arms.

In another existing class of collapsible garment hanger devices, the hangers have molded hinges and a device for locking the movable arms in an up position. However, as in the previous mentioned folding designs, this type of hanger often does not collapse enough to fit small-necked garments easily, such as turtlenecks.

Yet another existing collapsible hanger device uses a swinging arm design. This variant consists of two arms that are attached to the hook element in such a manner that they collapse by swinging together to form one arm with an asymmetrically located hook. This design allows for easy insertion of the hanger into the neck of even the smallest necked garment. However, as this device too uses a spring-loaded swinging mechanism, it suffers from the varying garment weight problem that similar other spring-loaded devices have. However, rather than matching the proper spring force to hold up the garment once inserted, the device must match the spring force with that needed to push out and collapse the arms after insertion and before removal.

SUMMARY

The present invention is directed towards a garment hanger that allows the arms of the hanger to be collapsed. This permits garments such as shirts, blouses and dresses, especially small-necked garments, to be removed from and placed onto the hanger with relative ease and without stretch or hook damage.

In general, the collapsible garment hanger comprises a fixed arm with a hook element attached and a sliding arm. Either arm may also contain a longitudinally oriented slot. The sliding arm is connected to the fixed arm by way of the slot in such a manner that when the tip of the fixed arm is tilted upward, gravity will cause the sliding arm to slide into its extended position. Conversely, whenever the tip of the fixed arm tilts downward, gravity will cause the sliding arm to slide into its collapsed position. Though this hanger design allows an operator to extend and collapse the hanger with one hand using gravity, a user can also manually extend or collapse the hanger with two hands. As this hanger is asymmetric in its collapsed position, in so far as the hook element is attached in-line to the tip of the fixed arm, the hanger can be easily inserted into the neck of a small-necked garment. This is possible as, in order to fit over the collapsed hanger, the neck of the garment must only be as wide as the offset spacing created between the outer tip of the sliding arm when it is in the collapsed position and the opposing offset portion of the hanger.

The hanger may further comprise a crosspiece that extends through the aforementioned slot and attaches the sliding arm to the fixed arm. In one version of the collapsible garment hanger, the crosspiece consists of a guide bar. This variant consists of a fixed arm with a hook element attached, a sliding arm with a longitudinally oriented slot and a guide bar extending through the slot and attaching the sliding arm slidably to the fixed arm. This version further comprises a stop point at the tip of the sliding arm that stops the movement of the sliding arm towards the distal end of the fixed arm. When this version is collapsed, the small opposing offset spacing created between the outer tip of the sliding arm and the opposing offset portion of the hanger permits small-necked garments to fit over the collapsed hanger without being stretched. This offset point can be much smaller than the width of other collapsible hangers that use a two arm sliding design or a folding arm design.

This version of the hanger also has additional features that can be seen in most all variants of this hanger design. One such feature is the grasping point on the hook element. The grasping point allows for a firm grip on the hanger without the palm of the hand extending too low and interfering with the fabric of the garment. Another feature consists of holes in the fixed arm that serve to balance the weight of the sliding arm in its extended position. A further benefit of the way the hanger balances is the fact that, in the collapsed position, an empty hanger presents a visible telltale signature in an otherwise full garment rack that allows one to easily pick it out. When the hanger is empty and in the collapsed position in a closet or on a clothes rack, it can hang with the tip of the fixed part extended slightly above the level of any filled hangers. This makes empty hangers clearly visible and accessible to a user, acting as a flag to signify that the hanger is empty and available for use.

The movement of this hanger is made possible by the use of an assembly of dowels and a spacer. The sliding arm can extend and collapse because the assembly holds the sliding arm in place between the guide bar and the fixed arm. This dowel and spacer assembly retains a small spacing between the sides of the sliding arm and the fixed arm to permit movement of the sliding arm and hold the sliding arm at an angle determined by the slot shape.

A variant on this design can have a releasable guide bar that connects to the fixed arm through multiple holes in the fixed arm as well as a slot that is enlarged at the point furthest from the stop point. Both these features allow a user to change the hanging angle and shoulder length of the hanger. The releasable guide bar works by modifying the length to which the sliding arm can extend. If the guide bar is attached to a point nearer to the fixed arm's tip, the sliding arms extensible length will be shortened. While this will shorten the shoulder length of the hanger when it is in its fully extended position, it will not change the size of the offset spacing that determines the garment neck size through which the hanger will fit. Conversely, attaching the guide bar to a point further from the distal end of the fixed arm will lengthen the maximum shoulder length of the hanger. The enlarged slot on the other hand changes not the shoulder length but rather the hanging angle of the hanger. By enlarging the slot size nearest the distal end of the fixed arm the angle the sliding arm hangs at in its fully extended position will increase. This is because when gravity pulls at the tip of the sliding arm, it will hang downward until its distal end meet up with the top of the slot. The more the slot is enlarged, the greater the shoulder angle will be. Both of these features allow the hanger to work effectively with a greater variety of garments, such as those with differing sizes, weights, weaves and fabrics.

Yet another version of this hanger comprises a fixed arm with a hook element attached, a sliding arm with a longitudinally oriented slot, a crosspiece extending through the slot and attaching the sliding arm slidably to the fixed arm, and a sloped upper edge of the sliding arm. In this version, as before, whenever the distal end of the fixed arm tilts upward, gravity will cause the sliding arm to slide along the fixed arm away from the distal end of the fixed arm. Conversely, whenever the distal end of the fixed arm tilts downward, gravity will cause the sliding arm to slide along the fixed arm toward the distal end of the fixed arm. Additionally, the sliding arm in this version can be manually drawn away from or towards the distal end of the fixed arm.

This version also enjoys the main benefit of this design, namely the small offset spacing created between the outer tip of the sliding arm when it is in the collapsed position and the opposing offset portion of the hanger. This offset spacing determines the garment neck size through which the hanger will fit. Furthermore, this version may contain the additional elements seen in earlier described designs. These include the grasping point on the hook element, and the stop point at the tip of the sliding arm that stops the movement of the sliding arm towards the distal end of the fixed arm.

The crosspiece is either a guide bar that attaches the sliding arm slidably to the fixed arm or a cam shaped guide pin that is releasably connected to a mating hole in the fixed arm through the sliding arm slot. The cam shaped guide pin serves as a means to raise or lower the sliding arm relative to the fixed arm. This permits a user to adjust the angle of the sloped edge of the sliding arm and thereby change the shoulder angle of the hanger. Other elements in this design include balancing holes in the fixed arm, a lower section of the sliding arm that extends beyond the width of the sliding arm and detents at both ends of the slot. The latter two elements serve to keep the garment from catching on the sliding arm and stop the movement of the sliding arm respectively.

Yet another version of the collapsible garment hanger includes a fixed arm with a hook element attached, a sliding arm, and two longitudinally oriented slots, one in the fixed arm and one in the sliding arm. It also consists of a sloped upper edge on the sliding arm, a guide pin hole and a crosspiece slidably attaching the fixed arm to the sliding arm through the guide pin hole and the fixed arm slot. Further features include socket holes in the fixed arm behind the slot in the sliding arm and rivet shaped pins that pass through the sliding arm and snap onto the fixed arm through the socket holes. Whenever the distal end of the fixed arm of this hanger tilts upward, gravity will cause the sliding arm to slide along the fixed arm away from the distal end of the fixed arm. Conversely, whenever the distal end of said fixed arm tilts downward, gravity will cause said sliding arm to slide along the fixed arm toward the distal end of the fixed arm. Additionally, the sliding arm can be drawn manually away from or towards the distal end of the fixed arm. This version also enjoys the main benefit of this design, namely the small offset spacing created between the outer tip of the sliding arm when it is in the collapsed position and the opposing offset portion of the hanger. This offset spacing determines the garment neck size through which the hanger will fit.

Further important elements in this version of the collapsible hanger include a grasping point on the hook element and a sloped upper edge of the fixed arm that stops the movement of the sliding arm. Also included are detents at both ends of the slots in the fixed and sliding arms, balancing holes in the fixed arm, and a lower section of the sliding arm that extends beyond the width of the sliding arm. These three latter elements all serve the same purposes as their counterparts in earlier described variants of this collapsible hanger.

The last described variant of this collapsible garment hanger includes a fixed arm with a hook element attached, and a sliding arm slidably disposed within the fixed arm. In this version, as before, whenever the distal end of the fixed arm tilts upward, gravity will cause the sliding arm to slide along the fixed arm away from the distal end of the fixed arm. Conversely, whenever the distal end of the fixed arm tilts downward, gravity will cause the sliding arm to slide along the fixed arm toward the distal end of the fixed arm. Additionally, the sliding arm in this version can manually slide away from or towards the distal end of the fixed arm. This version also possesses the main benefit of this design, namely the small offset spacing created between the outer tip of the sliding arm when it is in the collapsed position and the opposing offset portion of the hanger. This offset spacing determines the garment neck size through which the hanger will fit.

Other elements in this hanger may include a grasping point on the hook element, at least one contact point on the upper side of the sliding arm and a mating point on the upper side of the fixed arm. The contact points permit the sliding arm to slide away from the distal end of the fixed arm until they mate with their mating points and stops the movement of the sliding arm. There is additionally at least one contact point on the lower side of the fixed arm and a mating point on the upper side of the sliding arm such that the sliding arm can slide away from the distal end of the fixed arm until the contact point mates with the mating point and stops its movement.

Furthermore, there is a stop point on the lower end of the sliding arm that rests against the lower portion of the fixed arm when the sliding arm is in the collapsed position. An end point on the distal end of the fixed arm also stops this same movement. A stop latch on the upper side of the fixed arm and a contact point on the upper side of the sliding arm also may exist such that the sliding arm can slide away from the distal end of the fixed arm until the contact point mates with the stop latch and stops its movement.

The various versions of the present gravity actuated collapsible garment hanger can be made of any appropriate material and can be an assembly of numerous individual parts if desired. However it is preferred that the arms of the hanger be of at most two pieces of material such as two molded plastic structures.

DESCRIPTION OF THE DRAWINGS

The specific features, aspects and advantages of the present invention will become better understood with regard to the following description, appended claims and accompanying drawings where:

DETAILED DESCRIPTION OF THE PREFERRED EMBODIMENTS

The present invention is generally related to garment hangers, and more specifically collapsible garment hangers. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein. Furthermore it should be noted that unless explicitly stated otherwise, the figures included herein are illustrated diagrammatically and without any specific scale, as they are provided as qualitative illustrations of the concept of the present invention.

A collapsible garment hanger according to the present invention includes a hook attached to a fixed arm, a sliding arm attached to the fixed arm by way of a guide bar, mating slots and/or guide pins, and sometimes a snap latch. The moving arm can be made to retract along or into the fixed arm either manually or through gravity by raising the end with the moving arm upward allowing the force of gravity to slide the moving arm towards the distal end of the fixed arm. After being inserted into the neck of a typical garment the moving arm can then be made to extend by tilting the hanger downward and allowing gravity to slide the moving arm into the extended position or by manually moving it into place. Once extended, the weight of the garment will provide sufficient friction to keep the moving arm in place.

Figure 1A:
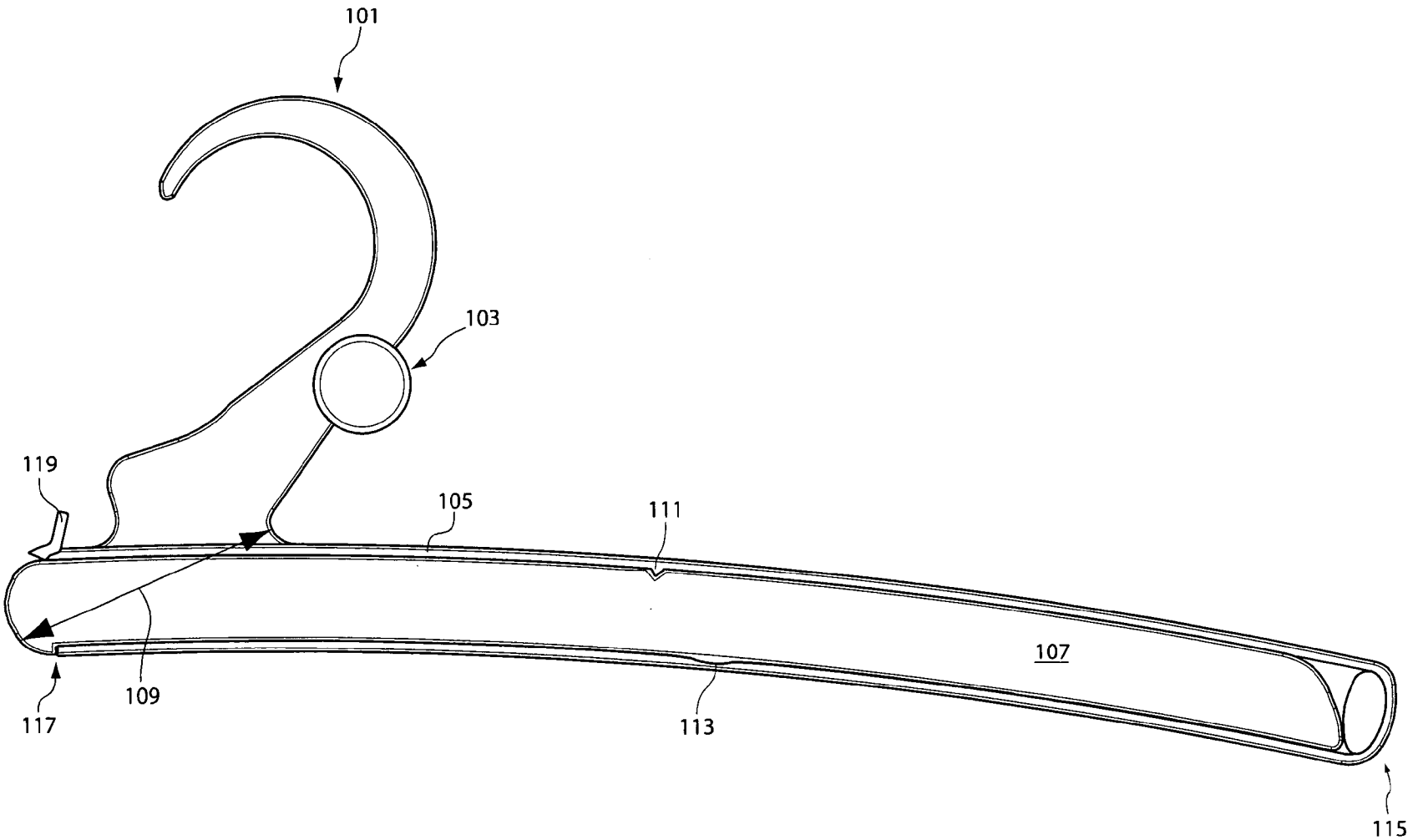
FIG. 1A shows an exemplary side view of one embodiment of a collapsible garment hanger according to the present invention in its retracted position.

In one embodiment of the collapsible garment hanger according to the present invention, arched arms are employed as shown in FIG. 1A, where a side view of the garment hanger in its retracted position is presented. The hanger consists of a hook element 101 and two arched arms, specifically a hollow fixed arm 105 and sliding arm 107. The hook element 101 is attached to the fixed arm 105 to provide support for the garment hanger when hanging on a clothes rod. This hook element 101 is located asymmetrically on the fixed arm 105 so its support is contiguous with it, but with an offset spacing 109. The hook element typically resembles the hook portion of any standard clothes hanger. However, it may be made to resemble the hook portion of more specialized garment hangers, such as those designed to hang clothes from non-standard clothes rods which are typically smaller in diameter than standard rods. Additionally, the hook element 101 may contain a grasping point 103 on either side of the hook element 101. A stop latch 119 may also be attached to the fixed arm 105 at the anterior end of the hook element 101. Additionally, the fixed arm 105 has a stop 115 attached to the distal end of the arm relative to the hook element 101, and a contact point 121 (shown in FIG. 1B) in its lower proximate end. The sliding arm 107 fits within the hollow fixed arm 105 such that it can slide back and forth within the fixed arm 105. The sliding arm 107 contains a minimum number of loosely fitting contact points including an upper contact point 111 and a lower contact point 113 that are disposed along the top and bottom of the sliding arm 107. These contact points act as stops when they mate with points along the inside portion of the fixed arm 105 as well as the stop latch 119. Additionally, the sliding arm 107 contains another contact point 117 located on the bottom which rests against the lower portion of the fixed arm 105 when the sliding arm 107 is in the retracted position.

The hook element 101 is located asymmetrically on the upper part of the fixed arm 105 such that it is contiguous with the fixed arm 105 but has a small offset spacing 109. This offset spacing 109 provides a minimum spacing between the outer tip of the sliding arm 107 and the opposing offset portion of the hanger when the sliding arm 107 is retracted. This allows for easy insertion or removal of the hanger from the neck of a garment as the small offset spacing 109 will allow the neck line of a garment to easily pass over the fixed arm 105 when the sliding arm 107 is in the retracted position. The grasping point 103 is an embossed region of the lower hook section. The grasping point 103 shown in FIG. 1A is a raised ring or ridge on either side of the hook element 101 and is of a similar nature to ridges that might be used to stiffen the hook along its edges. The position of the grasping point 103 on the hanger allows for a firm grip on the hanger without resulting in the palm of the hand extending too low and interfering with the fabric of the garment.

Additionally, the stop latch 119 may be utilized to stop the movement of the sliding arm 107. In one embodiment, as shown in FIG. 1A, a stop latch 119 is made smooth relative to the top exposed surface of the hanger. This permits movement of the sliding arm 107 between stops but when the upper contact point 111 reaches the proximate end of the fixed arm 105 it engages with the stop latch 119 to prevent further movement.

Additionally, lower contact point 113 on the sliding arm 107 can be made to mate with contact point 121 (shown in FIG. 1B) on the fixed arm when the fixed arm 105 is fully extended. The stop latch and/or contact points constrain the motion of the sliding arm 107 to the desired range. Once the hanger has been inserted into a garment with its sliding arm 107 in the fully extended position, the weight of the garment will provide sufficient friction to keep the sliding arm 107 in place.

Figure 1B:
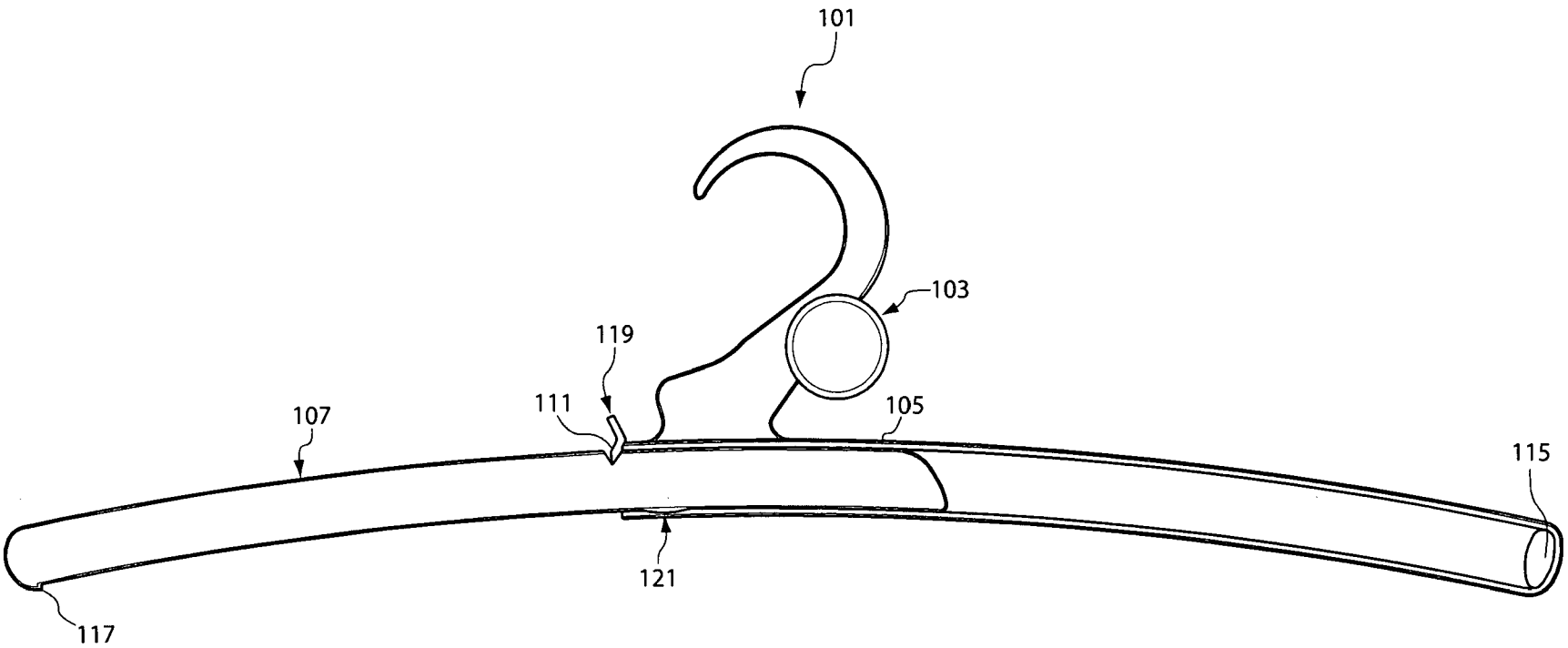
FIG. 1B shows an exemplary side view of the collapsible garment hanger of FIG. 1A in its extended position.

In one embodiment of the above described hanger the curved arms would permit gravity to slide the sliding arm 107 towards the distal end of the fixed arm 105 when the fixed arm 105 is tilted downward relative to the plane of the hanger. The stop point 115 and/or contact point 117 would constraint this movement, allowing it to retract until the tip of the sliding arm 107 is near the center of the hook element 101. Alternatively, when distal end of the fixed arm 105 is tilted upward relative to the plane of the hanger, the force of gravity would cause the sliding arm 107 to slide through the fixed arm 105 until it reaches its fully extended position as shown in FIG. 1B.

In another embodiment the sliding arm 107 may be manually extended or retracted to collapse or expand the hanger as desired by the user. The stop and/or contact points would act in the same manner a described previously.

Figure 2A:
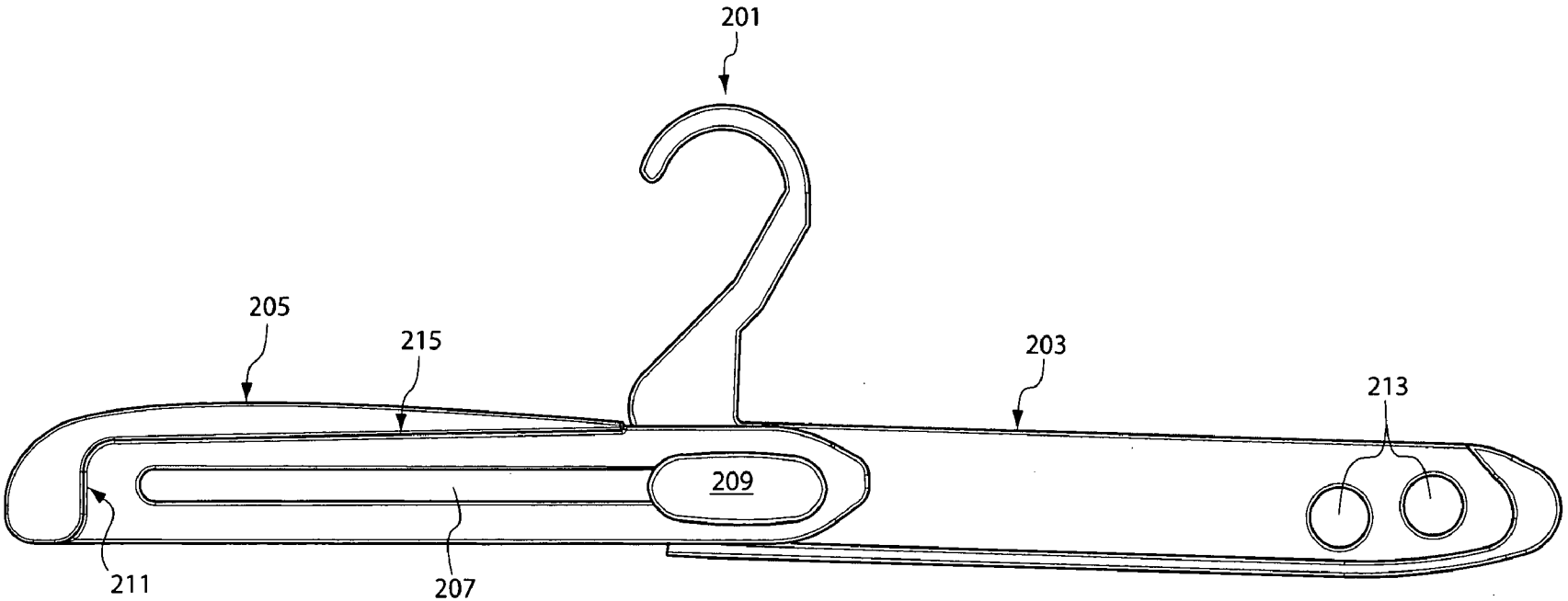
FIG. 2A shows an exemplary side view of another embodiment of a collapsible garment hanger according to the present invention in its extended position.

In an alternative embodiment of the collapsible garment hanger the fixed arm is attached to the sliding arm which slides along the fixed arm by way of a slot that is in the sliding arm. This sliding arm is attached to the fixed arm through a guide bar that extends through the slot in the sliding arm holding it in place but allowing it to slide back and forth. Referring to FIG. 2A where a side view of one embodiment of this type of garment hanger in its extended position is presented, a hook element 201 is located asymmetrically on the upper end of a fixed arm 203 such that it is contiguous with the fixed arm 203. A sliding arm 205 is attached to the fixed arm 203 by means of a guide bar 209. The guide bar 209 extends through a slot 207 made horizontally down the center of the sliding arm 205. In this manner, the sliding arm 205 can be made to extend and retract relative to the fixed arm 203 either through the force of gravity by tilting the distal end of the fixed arm 203 upwards or downwards, respectively, or by manually moving the sliding arm 205 in or out.

Figure 2B:
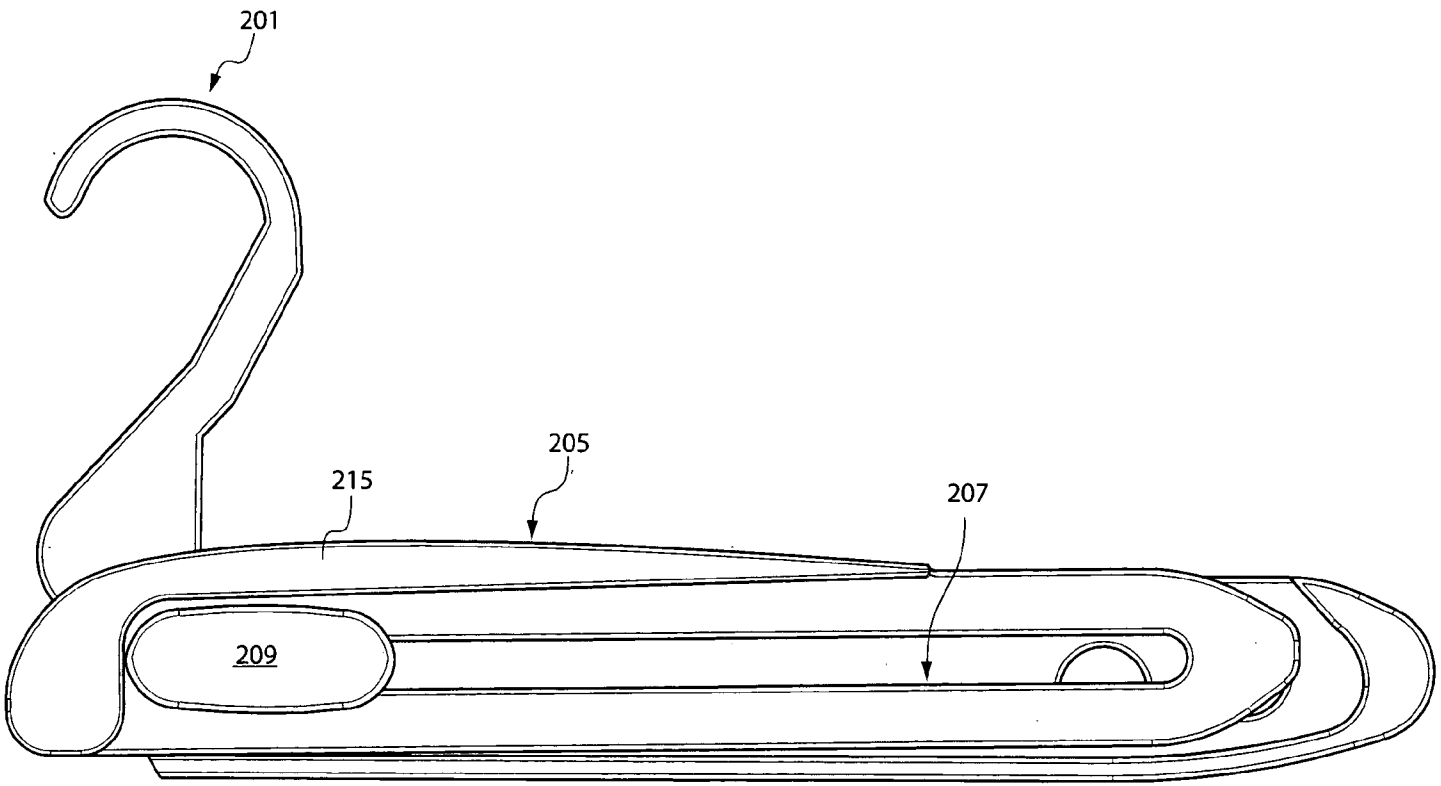
FIG. 2B shows an exemplary side view of the collapsible garment hanger of FIG. 2A in its retracted position.

In addition, a raised section 215 of the sliding arm 205 creates a stop point 211 at the tip of the sliding arm 205 and extends along the upper portion of the sliding arm 205 towards the distal end of the fixed arm 203. When the sliding arm 205 is in the collapsed position the stop point 211 rests against the guide bar 209 and stops the movement of the sliding arm 205. Holes 213 in the fixed arm 203 serve to balance the weight of the hanger when the sliding arm 205 is extended to hang the garment evenly. FIG. 2B shows this embodiment in the collapsed position.

Figure 3A:
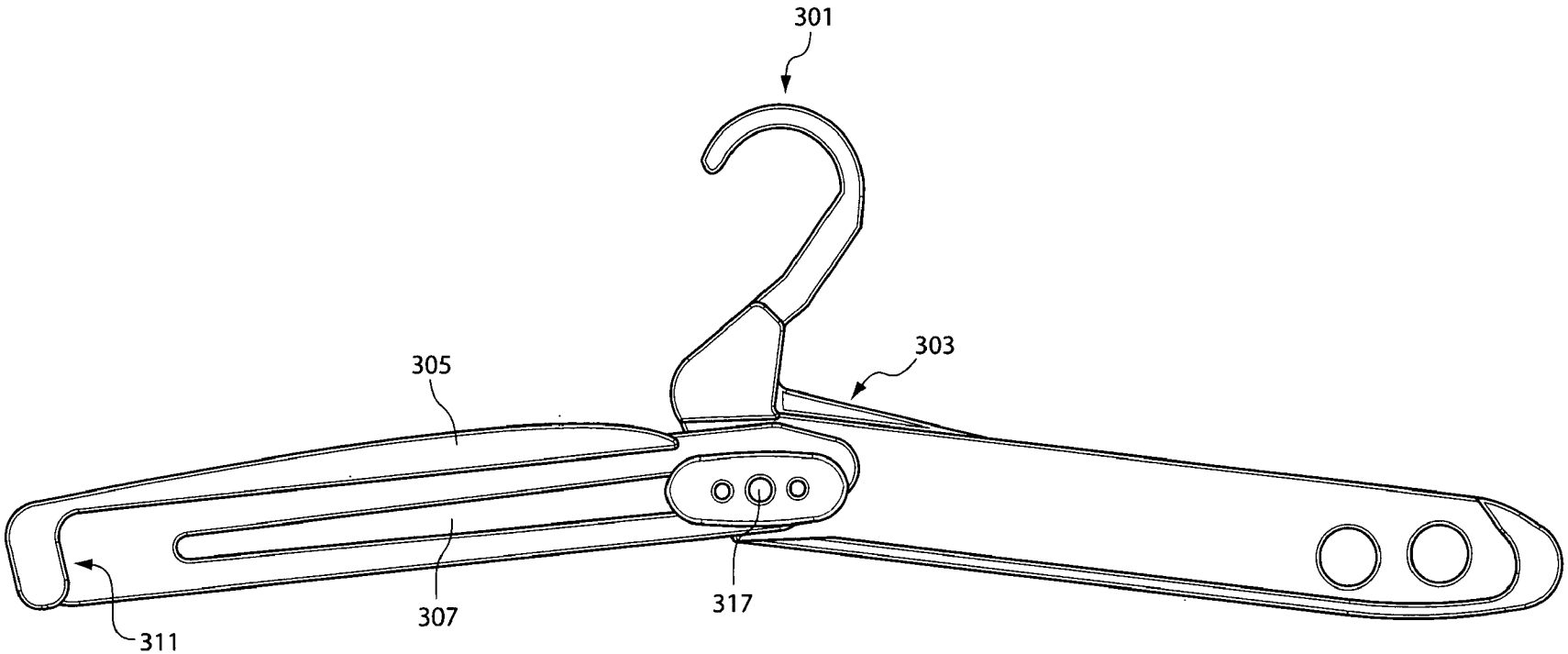
FIG. 3A shows an exemplary side view of yet another embodiment of a collapsible garment hanger according to the present invention in its extended position.
Figure 3B:
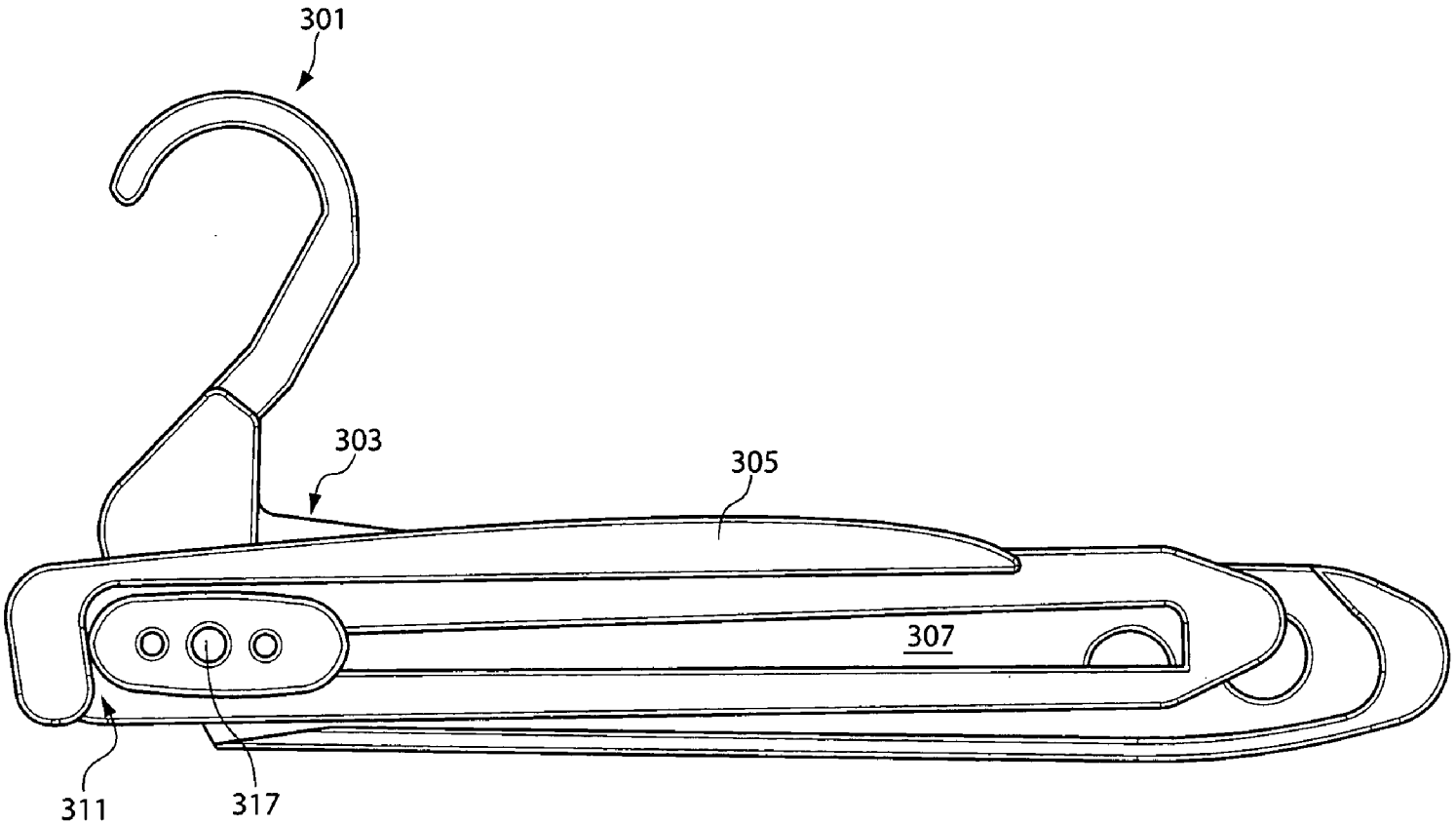
FIG. 3B shows an exemplary side view of the collapsible garment hanger of FIG. 3A in its retracted position.

In a variation of the collapsible garment hanger described in connection with FIGS. 2A and 2B, the slot in the sliding arm is enlarged at one end thereby allowing for an increase in the shoulder angle of the hanger when it is in its extended position. This increased shoulder angle will add gravitational stability to the hanger in the extended position to counter the forces from the garment that might otherwise cause the hanger slide to retract. Referring to FIG. 3A and FIG. 3B, these figures show side views of a collapsible hanger of a type described in reference to FIGS. 2A and 2B, shown in an extended and collapsed position, respectively. This embodiment, however, as is apparent in FIG. 3B, consist of a slot 307 on the sliding arm 305 that is enlarged at the point furthest from the stop point 311. Thus when the sliding arm 305 is extended, the force of gravity will pull the sliding arm 305 down until the guide bar contacts with the enlarged corner of the slot 307. This allows the shoulder angle of the hanger to be greater that it would be otherwise when the sliding arm 305 is extended.

Figure 3C:
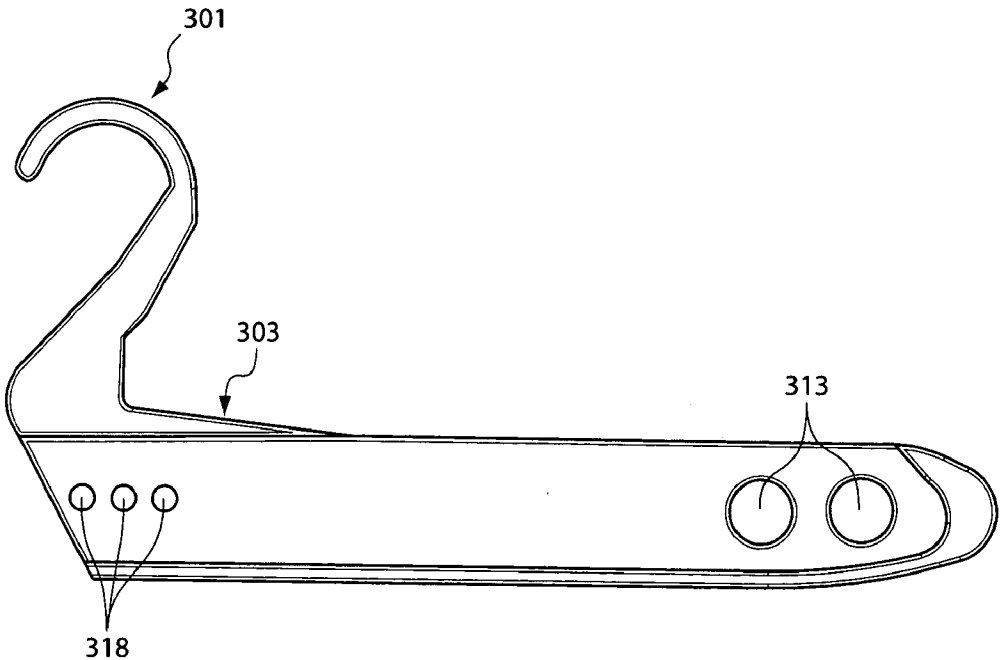
FIG. 3C shows an exemplary side view of the fixed arm of the collapsible garment hanger of FIG. 3A.
Figure 3D:
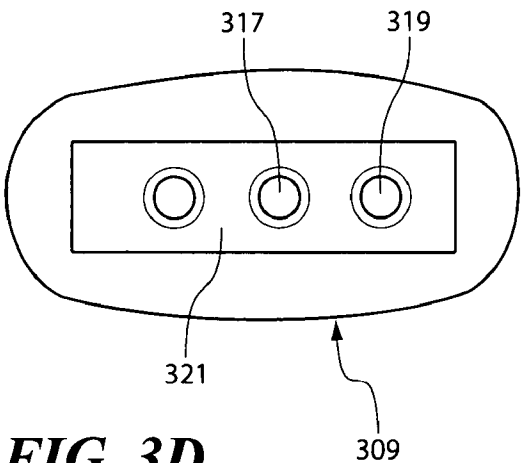
FIG. 3D shows an exemplary side view of the guide bar and spacer of the collapsible garment hanger of FIG. 3A.

Another feature of the collapsible garment hanger represented by FIGS. 3A, 3B, 3C and 3D is that the guide bar can be made removable. This allows the guide bar to be installed into various optional holes in the fixed arm in order to alter the shoulder angle and width of the hanger according to the desire of the user. The closer the hole used to attach the guide bar is to the distal end of the fixed arm, the smaller the shoulder angle and width will be when the sliding arm is in the fully extended position. Referring to FIGS. 3A, 3B and 3D the guide bar is attached to the fixed arm 303 through the sliding arm 305 by means of a removable screw 317. The guide bar 309 is also attached to the spacer 321 through dowels 319. The dowel 319 and spacer 321 hold the sliding arm 305 in place at an angle determined by the slot shape. Additionally, the spacer 321 retains a small spacing between the sides of the sliding arm 305 and the fixed arm 303 so as to permit free movement of the sliding arm 305. As can be seen in FIG. 3C, the guide bar can be removed and reattached to the fixed arm 303 by inserting the removable screw 317 through the sliding arm 305 into one of various holes 318 in the fixed arm 303. This changes the shoulder angle and width of the hanger when it is in the fully extended position.

Figure 4A:
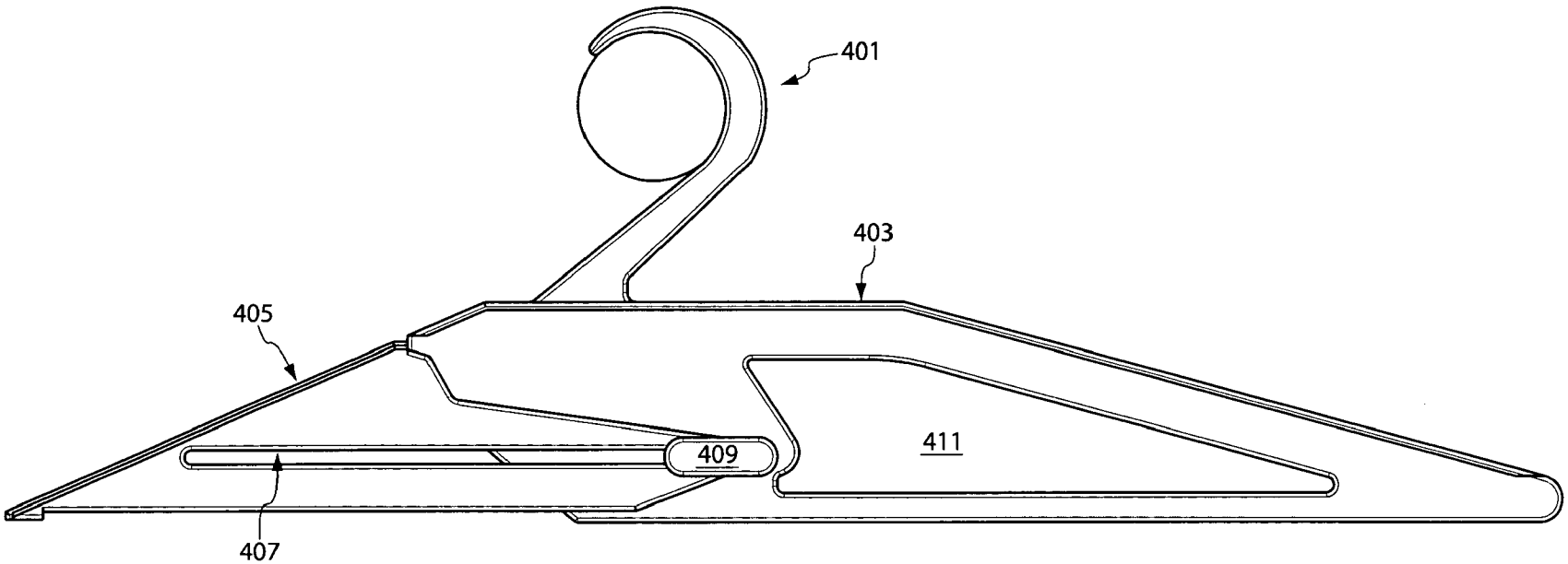
FIG. 4A shows an exemplary side view of yet another embodiment of a collapsible garment hanger according to the present invention in its extended position.

In another version of the collapsible garment hanger, two molded pieces, the fixed arm and the sliding arm, snap together to form a low cost embodiment of the hanger that allows for variable shoulder angles with a straight line slot. Referring to FIG. 4A where the side view of the this embodiment in its expanded position is presented, a hook element 401 is molded asymmetrically to the upper end of a fixed arm 403 such that it is contiguous with the fixed arm 403 in the same manner described previously for other embodiments of the present invention. The sliding arm 405, which is molded separately from the fixed arm 403, is attached to the fixed arm 403 by snapping the slot 407 onto the guide bar 409 during assembly. The guide bar 409 thus extends through the slot 407 and holds the sliding arm 405 in place while permitting it to move horizontally. The open section 411 of the fixed arm 403 serves to balance the weight of the hanger when the arm is extended to ensure the garment hangs evenly.

Figure 4B:
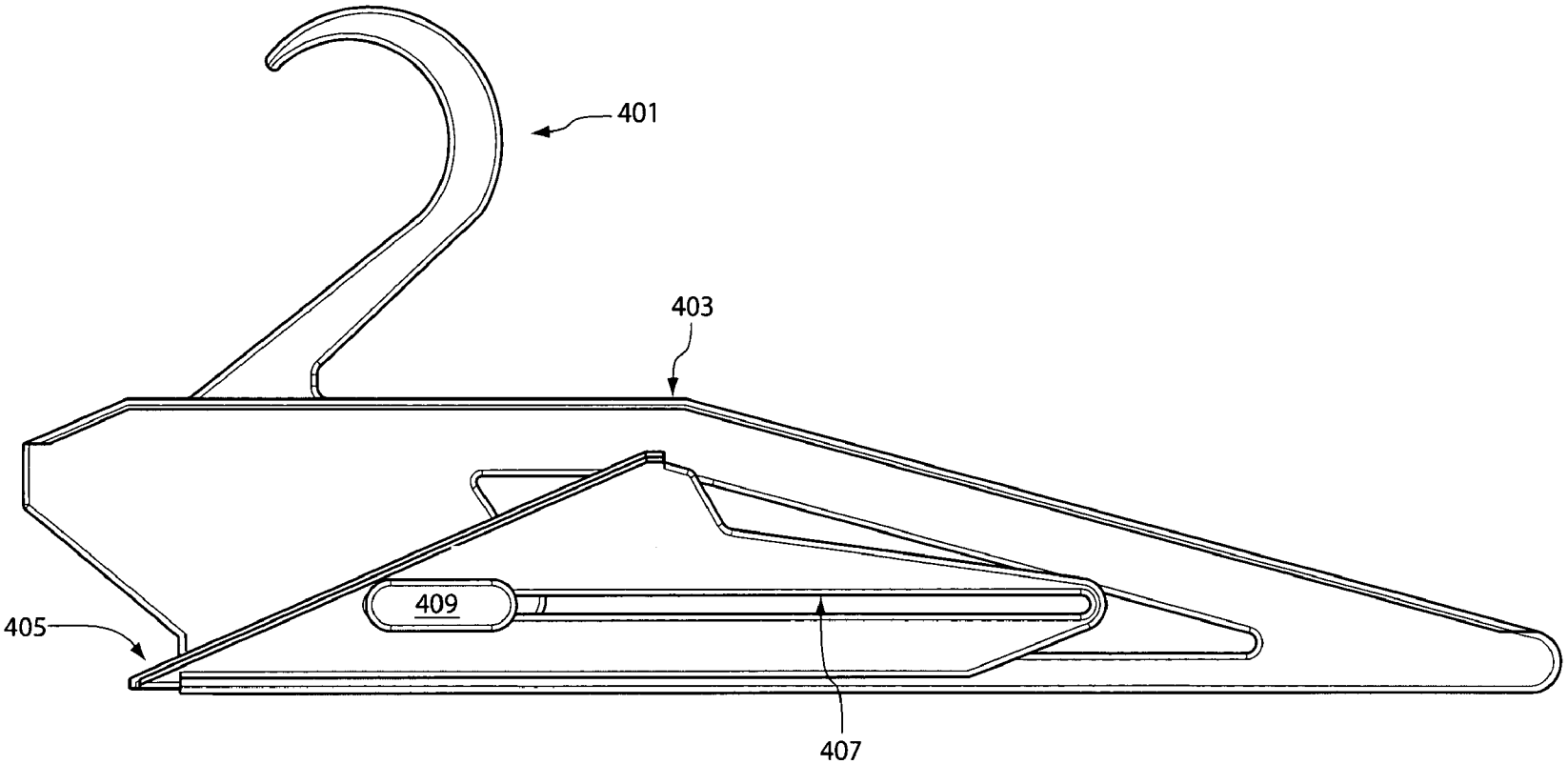
FIG. 4B shows an exemplary side view of the collapsible garment hanger of FIG. 4A in its retracted position.

This embodiment works much the same way as the previous described versions. Specifically, as shown in FIG. 4B the moving arm 405 can be made to retract into the fixed arm 403 manually or through gravity by raising the end with the moving arm 405 upward allowing the force of gravity to slide the moving arm 405 towards the distal end of the fixed arm 403. After being inserted in its retracted position into the neck of a typical garment the moving arm 405 can then be made to extend by tilting the hanger downward and allowing gravity to slide the sliding arm 405 into the extended position or by manually moving it into place. However, in this embodiment the upper edge of the sliding arm 405 is a molded sloped edge that creates a shoulder angle without the need for an asymmetrically enlarged slot to change the shoulder angle of the hanger.

Figure 6:
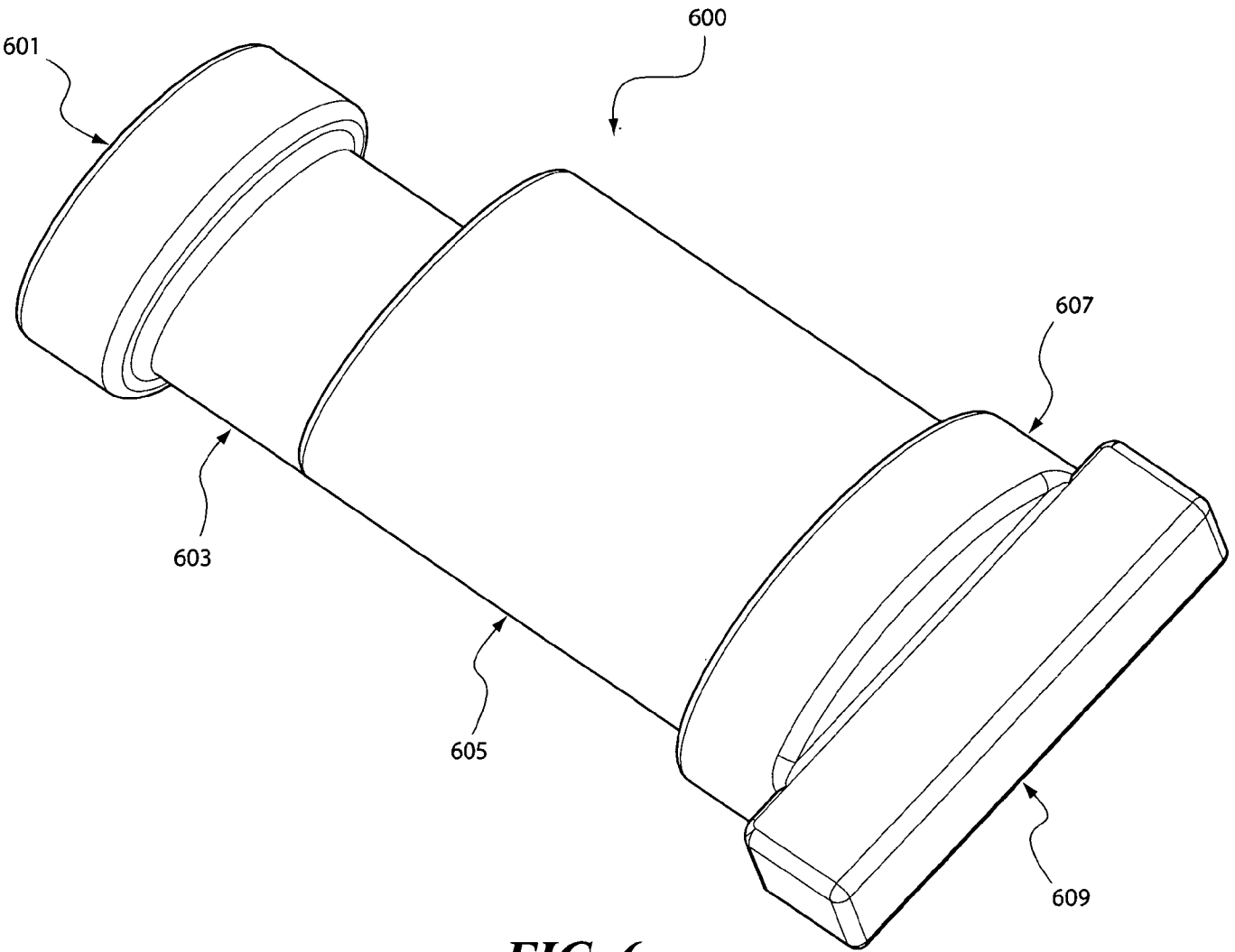
FIG. 6 shows an exemplary perspective view of a removable cam shaped guide pin according to the present invention that can alternatively be used in place of the fixed guide bar used in the collapsible garment hanger of FIG. 4A.

Alternatively, this embodiment can utilize a removable offset cam shaped guide pin rather than a fixed guide bar, thereby enabling an adjustable shoulder angle. In this embodiment a cam shaped guide pin 600, as shown in FIG. 6, is used as a separate snap-on pin, rather than a molded part of the fixed arm 403. The guide pin 600 consists of a seating shaft 601 attached to a cam 603 which is attached off center to the central part of the pin 605. On the other end of the pin is a flat thumb hold 609 attached to the top of the center of the pin 607.

In this embodiment the guide pin is seated by passing the seating shaft through the slot in the sliding arm 407 and then through a mating hole (not shown) in the fixed arm 403. The central part of the pin 605 is thus situated inside the slot 407 in the sliding arm 405. Once situated, by grasping the thumb hold 609 and rotating the guide pin, the cam would cause the central part of the pin 605 to rotate and raise or lower the sliding arm thereby changing the shoulder angle of the hanger to fit varying garment sizes. This embodiment would still permit the sliding arm 407 to expand and retract along the fixed arm 403 in the same manner described above.

Figure 5A:
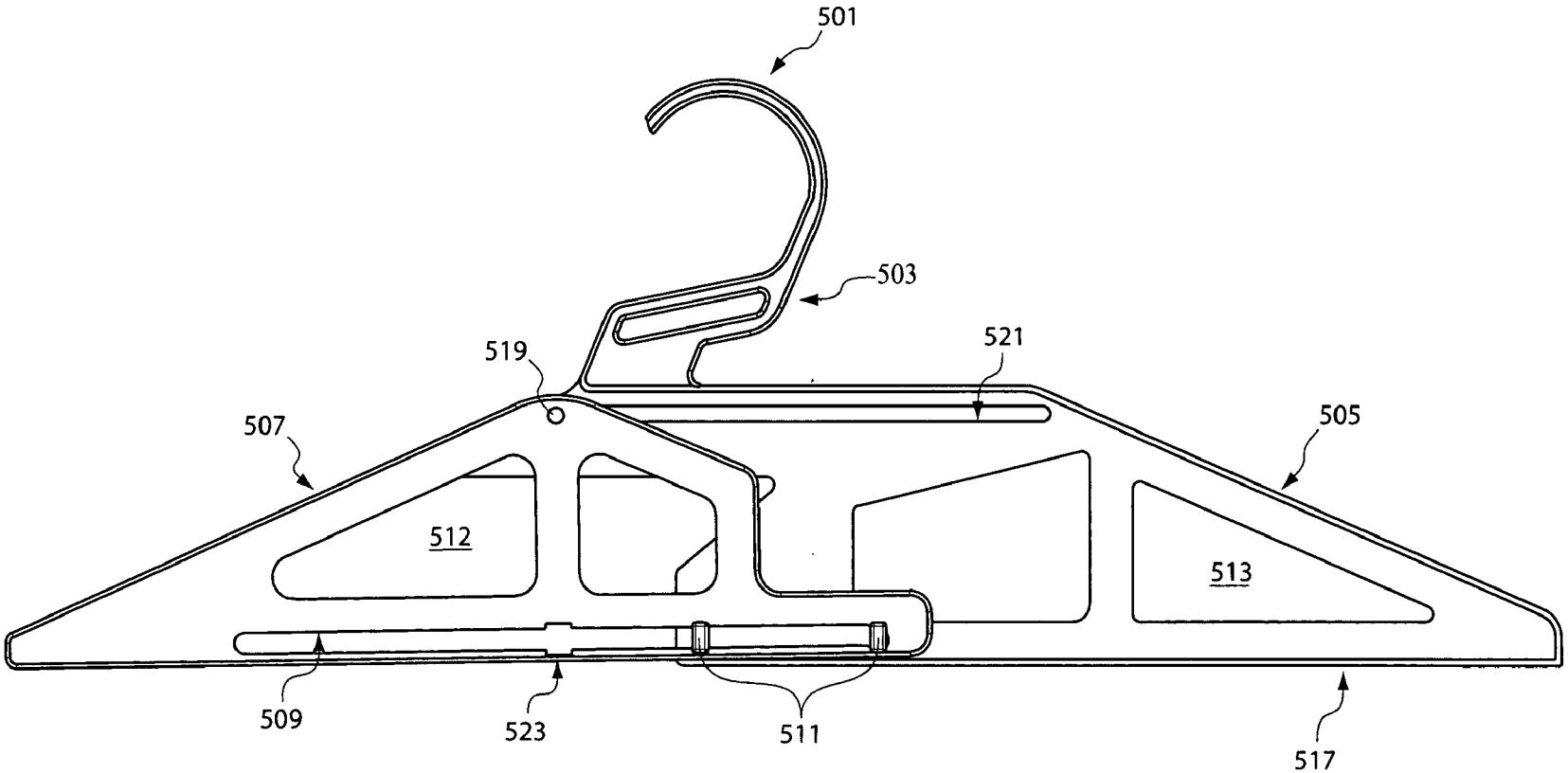
FIG. 5A shows an exemplary side view of yet another embodiment of a collapsible garment hanger according to the present invention in its extended position.

In another embodiment of the collapsible garment hanger rivet shaped pins can be set in socket holes in the fixed arm of the hanger. This would allow a user to incrementally change the shoulder angle and extension length by preventing movement of the sliding arm at varying points along the fixed arm. Referring to FIG. 5A where a side view of this embodiment is shown in the fully extended position, a hook element 501 with a grasping point 503 is located asymmetrically on the upper end of a fixed arm 505 such that it is contiguous with the fixed arm 505. A sliding arm 507 is attached to the fixed arm 505 by means of a guide pin 519 that passes through the top corner of the sliding arm 507 and snaps to the upper slot 521 located on the fixed arm 505. The guide pin, while attaching the sliding arm 507 to the fixed arm 505, would permit the sliding arm 507 to move along the length of the upper slot 521 manually or through the force of gravity as described above. Additionally a lower slot 509 is in the sliding arm 507 and socket holes (not shown) are in the fixed arm 505 directly behind the lower slot 509. This construction would permit rivet shaped pins 511 to pass through the sliding arm 507 and snap onto the fixed arm 505 through the socket holes. In this manner the sliding arm 507 will slide along the fixed arm 505 manually or through the force of gravity but its forward movement would be stopped when the distal end of the sliding arm 507 slides against the rivet shaped pins 511 set in the socket holes. This construction allows a user to set a desired shoulder angle or extension length by inserting a pin into the appropriate socket hole 511. If a pin is inserted into a socket hole on the fixed arm 505 at a point closest to the hook 501, the sliding arm 507 can be made to slide the full length of the fixed arm 505 and will create the maximum extension length of the hanger needed for larger garments. The placement of the pin in this position will also create the smallest shoulder angle possible for this hanger. If, however, the pin is inserted into a socket hole furthest from the hook 501, then the shoulder angle created with the sliding arm 507 in its fully extended position will be increased and the extension length of the hanger will be reduced.

In an alternate embodiment the fixed and sliding arms 505 and 507 can be molded contiguously with the pins 519 and 511 such that pin 519 can be first assembled into slot 521 by rotating sliding arm 507 90 degrees with respect to fixed arm 505. Then pins 511 are snapped through the opening 523 in two steps, when the pins 511 and opening 523 are sequentially aligned. Once assembled, the hanger of FIG. 5A is stable.

It should be noted that the embodiments described below represent alternative embodiments described herein, and that any or all of these alternate embodiments, may be used in combination with other alternative embodiments that are described throughout this document.

Figure 5B:
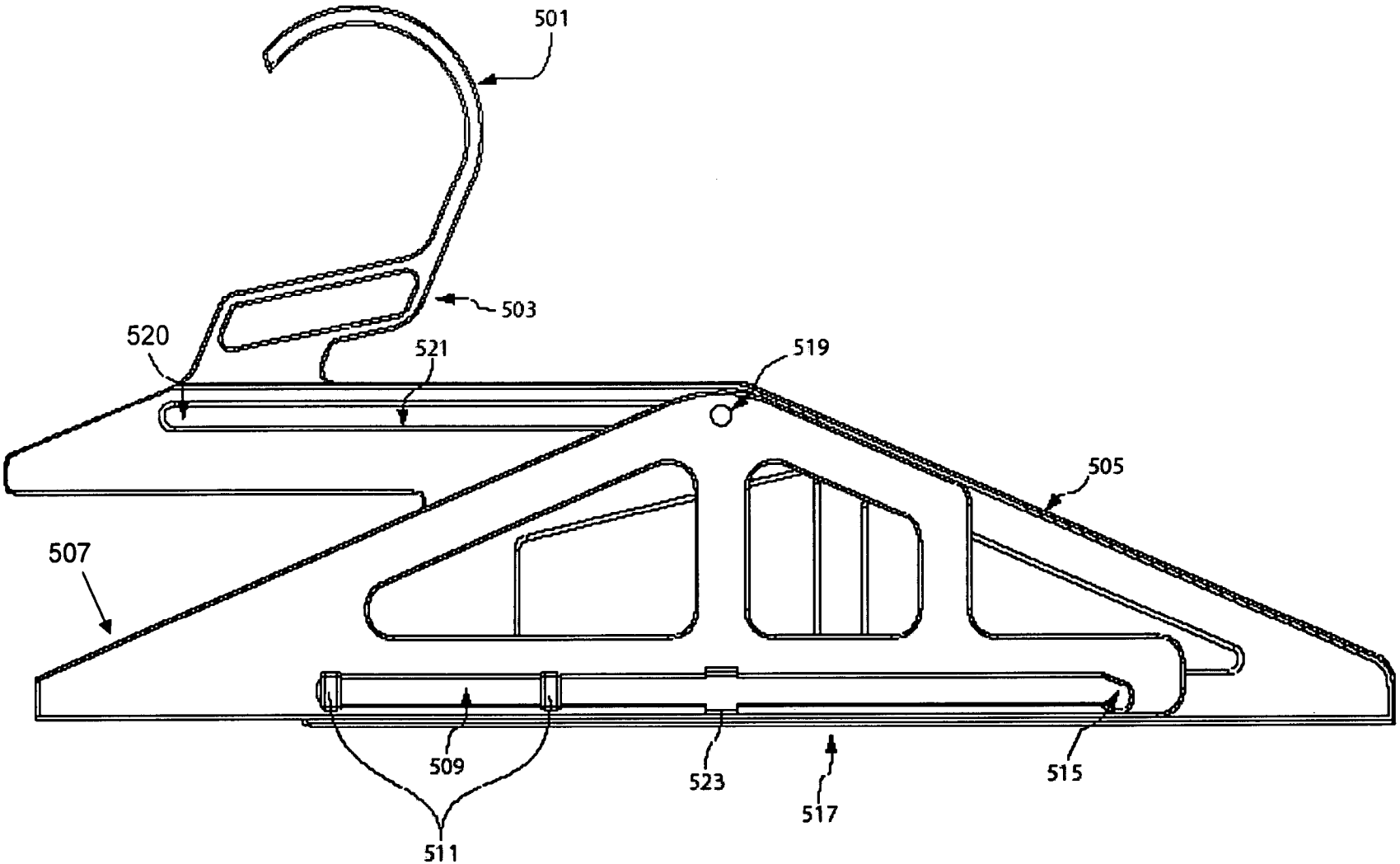
FIG. 5B shows an exemplary side view of the collapsible garment hanger of FIG. 5A in its retracted position, and also shows the detail of an alternative embodiment in which the slots in both the fixed and sliding arms of the hanger have a detent at their endpoint.

In one alternative embodiment the slots in both the fixed and sliding arms have a detent at an endpoint. Referring to FIG. 5B, the detents in the slots are shown as small curved portions of the slots located at one end of the lower slot 515, and one end of the upper slot 520. In this embodiment the detents serve to restrain the sliding arm 507 from moving when it is in its extended position within a garment by acting as a catch that holds onto any guide pin when the hanger is in its extended position.

In another alternative embodiment a molded lower extension is used to support the extended moving arm at the lower left of the fixed arm and to also cover the moving arm to avoid interfering drag from any garment folds of fabric that might be present at that location. As is shown in FIGS. 5A and 5B, the molded lower extension 517 sits directly below the sliding arm 507 of the hanger and extends slightly beyond the width of the sliding arm 507. The lower extension 517 will therefore hold the garment fabric away from the sliding arm 507 once the hanger is inserted in the garment and therefore prevent the movement of the arm from being slowed or stopped by any of the garment fabric.

In another alternative embodiment holes or open sections are made in the distal end of the fixed arm as well as the sliding arm to balance hanger in extended position. As is shown in FIG. 5A portions of the distal end of the molded fixed arm have been removed leaving holes 513 in the hanger. Holes 512 are also shown in the same figure in the center of the sliding arm. This allows the hanger to hang garments evenly by balancing the weight of the hanger when it is in the extended position.

The various versions of the present gravity actuated collapsible garment hanger can be made of any appropriate material and can be an assembly of numerous individual parts if desired. However it is preferred that the arms of the hanger be of at most two pieces such as two molded plastic structures.

What is claimed is:

1. A collapsible garment hanger with two arms comprising:

a single fixed arm;

a hook element attached to the fixed arm;

a single sliding arm with a longitudinally oriented slot; and a crosspiece extending through the slot and attaching the sliding arm slidably to the fixed arm.

2. The collapsible garment hanger of claim 1, wherein whenever the distal end of the single fixed arm is tilted upward, gravity will cause the single sliding arm to slide along the fixed arm away from the distal end of the fixed arm, and wherein whenever the distal end of the single fixed arm is tilted downward, gravity will cause the single sliding arm to slide along the fixed arm toward the distal end of the fixed arm.

3. The collapsible garment hanger of claim 1, wherein the single sliding arm can be manually slid away from or towards the distal end of the single fixed arm.

4. The collapsible garment hanger of claim 1, wherein the distance between the outer tip of the sliding arm when it is in the collapsed position and the opposing offset portion of the hanger defines an offset spacing that determines the size of neck of garment that the hanger will fit through, and wherein said spacing is made to allow the two hanger arms to fit into a garment by passing though the neck of the garment.

5. A collapsible garment hanger with two arms comprising:

a single fixed arm;

a hook element attached to the fixed arm;

a single sliding arm with a longitudinally oriented slot; and a guide bar extending through the slot and attaching the sliding arm slidably to the fixed arm.

6. The collapsible garment hanger of claim 5, wherein whenever the distal end of the single fixed arm is tilted upward, gravity will cause the single sliding arm to slide along the fixed arm away from the distal end of the fixed arm, and wherein whenever the distal end of the single fixed arm is tilted downward, gravity will cause the single sliding arm to slide along the fixed arm toward the distal end of the fixed arm.

7. The collapsible garment hanger of claim 5, wherein the single sliding arm can be manually slid away from or towards the distal end of the single fixed arm.

8. The collapsible garment hanger of claim 5, further comprising an offset spacing between the outer tip of the single sliding arm when it is in the collapsed position and the opposing offset portion of the hanger.

9. The collapsible garment hanger of claim 5, wherein the distance between the outer tip of the single sliding arm when it is in the collapsed position and the opposing offset portion of the hanger defines an offset spacing that determines the size of neck of garment that the hanger will fit through, and wherein said spacing is made to allow the two hanger arms to fit into a garment by passing though the neck of the garment.

10. The collapsible garment hanger of claim 5, further comprising a grasping point on the hook element.

11. The collapsible garment hanger of claim 5, further comprising holes in the single fixed arm, whereby the single sliding arm attaches to the fixed arm through the guide bar that extends through the slot in the sliding arm and into one of said holes in the fixed arm.

12. The collapsible garment hanger of claim 5, where wherein the guide bar is releasably connected to the single fixed arm.

13. The collapsible garment hanger of claim 5, further comprising dowels and a spacer; wherein the dowels extend through and attach the spacer to the guide bar; and wherein the spacer retains a small spacing between the sides of the single sliding arm and the single fixed arm to permit movement of the sliding arm.

14. The collapsible garment hanger of claim 13, wherein the dowels and spacer fits within the slot in the single sliding arm and holds the sliding arm at an angle determined by the slot shape.

15. The collapsible garment hanger of claim 5, wherein the slot is enlarged at the point furthest from the stop point.

16. The collapsible garment hanger of claim 1 further comprising a crosspiece extending through the slot and attaching the single sliding arm slidably to the single fixed arm; and a sloped upper edge of the sliding arm.

17. The collapsible garment hanger of claim 1, further comprising a grasping point on the hook element.

18. The collapsible garment hanger of claim 1, further comprising a stop point at the edge of the single sliding arm that stops the movement of the sliding arm towards the distal end of the single fixed arm.

19. The collapsible garment hanger of claim 1, wherein the crosspiece is a guide bar extending through the slot and attaching the single sliding arm slidably to the single fixed arm.

20. The collapsible garment hanger of claim 19, wherein the guide bar is a cam shaped guide pin that is releasably connected to a mating hole in the single fixed arm through the single sliding arm slot.

21. The collapsible garment hanger of claim 1, further comprising a section of the single fixed arm that extends beneath the single sliding arm and is at least as wide as the width of the sliding arm.

22. The collapsible garment hanger of claim 1, further comprising detents at either end of the slot such that the detents stop the movement of the single sliding arm when they contact the guide bar.

23. The collapsible garment hanger of claim 1, further comprising balancing holes in the single fixed arm.

24. A collapsible garment hanger comprising:

a fixed arm;

a hook element attached to the fixed arm;

a sliding arm;

a longitudinally oriented slot in said fixed arm;

a longitudinally oriented slot in said sliding arm;

a sloped upper edge of the sliding arm;

a guide pin hole in said sliding arm;

a crosspiece slidably attached to the slot in the fixed arm through the guide pin hole in the sliding arm;

socket holes in the fixed arm behind the slot in the sliding arm; and rivet shaped pins that pass through the sliding arm and snap onto the fixed arm through said socket holes.

25. The collapsible garment hanger of claim 24, wherein whenever the distal end of said fixed arm is tilted upward, gravity will cause said sliding arm to slide along the fixed arm away from the distal end of the fixed arm and wherein whenever the distal end of said fixed arm is tilted downward, gravity will cause said sliding arm to slide along the fixed arm toward the distal end of the fixed arm.

26. The collapsible garment hanger of claim 24, wherein the sliding arm can be manually slid away from or towards the distal end of the fixed arm.

27. The collapsible garment hanger of claim 24, wherein the distance between the outer tip of the sliding arm when it is in the collapsed position and the opposing offset portion of the hanger defines an offset spacing that determines the size of neck of garment that the hanger will fit through, and wherein said spacing is made to allow the hanger arms to fit into a garment by passing though the neck of said garment.

28. The collapsible garment hanger of claim 24, further comprising a grasping point on the hook element.

29. The collapsible garment hanger of claim 24, further comprising a sloped upper edge of distal end of the fixed arm that stops the movement of the sliding arm towards the distal end of the fixed arm.

30. The collapsible garment hanger of claim 24, further comprising detents at either end of said slot such that said detents stop the movement of the sliding arm when they contact said rivet shaped pins.

31. The collapsible garment hanger of claim 24, further comprising balancing holes in the fixed arm.

32. The collapsible garment hanger of claim 24, further comprising a section of the fixed arm that extends beneath the sliding arm and is at least as wide as the width of the sliding arm.

33. A collapsible garment hanger with two arms comprising:

a single fixed arm;

a hook element attached to the fixed arm; and a single sliding arm slidably disposed within the fixed arm.

34. The collapsible garment hanger of claim 33, wherein whenever the distal end of the single fixed arm is tilted upward, gravity will cause the single sliding arm to slide within the fixed arm away from the distal end of the fixed arm, and wherein whenever the distal end of the single fixed arm is tilted downward, gravity will cause the single sliding arm to slide within the fixed arm toward the distal end of the fixed arm.

35. The collapsible garment hanger of claim 33, wherein the single sliding arm can be manually slid away from or towards the distal end of the single fixed arm.

36. The collapsible garment hanger of claim 33, wherein the distance between the outer tip of the single sliding arm when it is in the collapsed position and the opposing offset portion of the hanger defines an offset spacing that determines the size of neck of garment that the hanger will fit through, and wherein said spacing is made to allow the two hanger arms to fit into a garment by passing though the neck of the garment.

37. The collapsible garment hanger of claim 33, further comprising a grasping point on the hook element.

38. The collapsible garment hanger of claim 33, further comprising at least one protrusion or contact point on the upper side of the single sliding arm and a recess or mating point on the upper side of the single fixed arm such that the sliding arm can slide away from the distal end of the fixed arm until the contact point mates with the mating point and stops its movement.

39. The collapsible garment hanger of claim 33, further comprising at least one protrusion or contact point on the lower side of the single sliding arm and a recess or mating point on the lower side of the single fixed arm such that the sliding arm can slide away from the distal end of the fixed arm until the contact point mates with the mating point and stops its movement.

40. The collapsible garment hanger of claim 33, further comprising a stop or end point attached to the distal end of the single fixed arm such that said end point will stop the movement of the single sliding arm towards the distal end of the fixed arm.

41. The collapsible garment hanger of claim 33, further comprising a protrusion on the lower tip of the single sliding arm that rests against the lower portion of the single fixed arm when the sliding arm is slid towards the distal end of the fixed arm thereby stopping the movement of the sliding arm.

42. The collapsible garment hanger of claim 33, further comprising a stop latch on the upper side of the single fixed arm and a protrusion or contact point on the upper side of the single sliding arm such that the sliding arm can slide away from the distal end of the fixed arm until the contact point mates with the stop latch and stops its movement.

* * * * *